US009147355B2

(12) United States Patent
Piccoli et al.

(10) Patent No.: US 9,147,355 B2
(45) Date of Patent: Sep. 29, 2015

(54) ADVERTISEMENT CLIP FOR HARD TAGS

(71) Applicant: Checkpoint Systems, Inc., Thorofare, NJ (US)

(72) Inventors: Anthony F. Piccoli, West Deptford, NJ (US); Thomas J. McKeown, Pennsauken, NJ (US); Gary T. Mazoki, Sewell, NJ (US); Brennan Bradley, Chadds Ford, PA (US); Seth Strauser, Mullica Hill, NJ (US); James Brodzik, Somerdale, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 5 days.

(21) Appl. No.: 14/211,855

(22) Filed: Mar. 14, 2014

(65) Prior Publication Data

US 2014/0259836 A1 Sep. 18, 2014

Related U.S. Application Data

(60) Provisional application No. 61/788,481, filed on Mar. 15, 2013.

(51) Int. Cl.
*G09F 3/16* (2006.01)
*E05B 73/00* (2006.01)

(52) U.S. Cl.
CPC ..... *G09F 3/16* (2013.01); *E05B 73/0017* (2013.01); *Y10T 29/49826* (2015.01)

(58) Field of Classification Search
CPC ..... G06K 19/07749; G06K 19/0723; G06K 19/077; G07F 7/1008; G06Q 20/341; G09F 3/208; G09F 1/10; G09F 3/20; G09F 3/16
USPC ..... 40/658, 647, 648, 666, 661.06, 661.07, 40/669, 668, 313, 661
See application file for complete search history.

(56) References Cited

U.S. PATENT DOCUMENTS

| | | | | |
|---|---|---|---|---|
| 1,418,222 | A * | 5/1922 | Zeller | 40/1.5 |
| 2,028,323 | A * | 1/1936 | Goodman | 40/488 |
| 6,069,596 | A * | 5/2000 | Marvin et al. | 345/52 |
| 7,453,370 | B2 * | 11/2008 | Marsilio et al. | 340/686.1 |
| 7,635,089 | B2 * | 12/2009 | Augustinowicz et al. | 235/486 |
| 7,893,838 | B2 * | 2/2011 | Kolton et al. | 340/572.1 |
| 8,191,292 | B2 * | 6/2012 | Cummings et al. | 40/329 |
| 2009/0300959 | A1 * | 12/2009 | McNutt et al. | 40/649 |
| 2010/0213263 | A1 * | 8/2010 | Ho et al. | 235/487 |
| 2012/0105231 | A1 * | 5/2012 | Strassburger et al. | 340/572.1 |
| 2014/0123525 | A1 * | 5/2014 | Payne | 40/359 |

* cited by examiner

*Primary Examiner* — Casandra Davis

(57) ABSTRACT

An advertisement clip and method for supplementing a security hard tag with the advertisement clip for application to a product. The advertisement clip may include indicia on the surface of the clip or may hold or enclose an information element that provides the indicia to the manufacturer, retailer, and/or customer. Indicia may be visible and can include promotional information, pricing, images, customer specific branding, and/or barcodes.

16 Claims, 7 Drawing Sheets

ADVERTISEMENT CLIP FOR HARD TAGS

CROSS REFERENCE TO RELATED APPLICATIONS

The present application is related to U.S. Provisional Patent Application Ser. No. 61/788,481 entitled ADVERTISEMENT CLIP FOR HARD TAGS filed on Mar. 15, 2013, the contents of which are incorporated fully herein by reference.

FIELD OF THE INVENTION

The present disclosure relates generally to a security hard tag and clip device. In particular, the disclosure relates to an advertisement clip device and method for supplementing a security hard tag with the advertisement clip to form an advertisement clip hard tag. The advertisement clip both enhances and attaches to the security hard tag. The advertisement clip may contain indicia which provide an additional feature for a security hard tag when coupled to a product.

BACKGROUND

Electronic article surveillance (EAS) includes the tracking and/or detection of items that are warehoused, inventory-controlled, and/or located at a retail establishment. EAS is achieved by applying an EAS element as part of a security tag to the item, or its packaging, and when the security tag is exposed to a predetermined electromagnetic field (e.g. pedestals located at a retail establishment exit), it activates to provide some type of alert and/or to supply data to a receiver or other detector. In the EAS industry, a "hard tag" refers to either a re-usable or disposable tag which is intended to be removed from merchandise at the point of sale, and then to be re-used on other merchandise or simply thrown away. Hard tags typically are constructed to contain an EAS element, which may be, for example, an acousto-magnetic element (AM), a radio frequency element (RF), or an electro-magnetic element (EM). Tags may also be constructed to contain a radio frequency identification (RFID) element, which may respond at low, high, or ultra high frequencies.

An EAS element may include a resonant circuit with a coil coupled to a capacitor. The EAS security element is tuned to a predetermined frequency and if one attempts to remove the hard tag with the security element from a store, an alarm triggers as the tag passes through a surveillance field created by a transmitter and receiver located between pedestals at the store exit, tuned to the same frequency. The alarm goes off as the EAS element resonates, providing an output signal detected by a receiver, also located in the pedestals.

An RFID element typically includes an integrated circuit (IC) and an RF LC circuit (resonant circuit) or antenna (e.g. a dipole antenna), tuned to a predetermined RF frequency. Often, the integrated circuit (IC) comprises memory that has been programmed with information associated with the article (e.g., product ID information such as a serial number, unique identification number, price, etc.). When a transmitter emits a signal at the predetermined RF frequency and threshold value which is received by the tuned antenna, the RFID element emits a signal containing the stored information which is then received by a receiver and the information demodulated from the element-emitted signal. This information can then be used for, among other things, determining whether to set off an alarm or not. The RFID tag may also be used for merchandise visibility and inventory control, to identify where a tag and associated product are located or where they have moved to or from within the store.

In alternative to an EAS element embedded in a hard tag, the hard tag may be equipped as a benefit denial tag. A benefit denial tag typically includes ink releasing elements, such that when an attempt to break the tag from a product is performed, glass vials of ink shatter within the tag, ultimately leaking about the product which devalues the product and likewise provides notification to the retailer that that particular merchandise was tampered with.

Retail stores typically utilize only one of the above security technologies in a hard tag for application to products. The hard tags are typically applied to the external portion of merchandise so that it is visible to both the potential customer and retail employee. The visible hard tag serves as a warning that the merchandise is tagged with a security element. The hard tag is made visible as a reminder to the store employee to detach the hard tag once the customer has paid. The surface of the hard tag is often one color. To many retailers, the hard tags are considered a visual hindrance and distract from the presentation of the merchandise. Since the hard tag must often remain externally attached to the merchandise for the reasons described above, it would be advantageous to provide indicia for inclusion with the hard tag for display to the customer or for utilization by the retail employee.

What is needed is a device and method to supplement a security hard tag with indicia, such as for example promotional advertisements. An advertisement clip may be affixed to a hard tag including visible indicia such as advertisement promotions, pricing, merchandise information, or customer specific branding. The advertisement clip may contain indicia intended for use by the store employee, such as a barcode. The visible indicia may be in the form of an image that may diminish the visual hindrance of the hard tag when attached to merchandise. The advertisement clip may be affixed and removed by the retailer or merchandise manufacturer to update the indicia, as for example for a particular sales event.

SUMMARY

Embodiments of this disclosure provide an advertisement clip to attach to a hard tag. The advertisement clip provides an additional feature for the hard tag as for providing indicia to the customer, retailer, or manufacturer in addition to providing security for the retail establishment. The advertisement clip attaches about the hard tag and is secured to the hard tag for when the hard tag is attached to merchandise.

Embodiments of this disclosure are directed to a clip for a security hard tag. The clip includes a clip housing and indicia about the clip housing. The clip housing is configured to attach to a hard tag housing of the security hard tag.

According to one embodiment, the indicia is located on the surface of the clip housing.

According to another embodiment, the clip also includes an information element. The indicia is located on or within the information element.

According to one aspect of one embodiment, the indicia is displayed on the information element in at least one form of an advertisement, a price, a bar code, a promotional, a logo, an image, or a product description.

According to another aspect of another embodiment, the information element is a RFID inlay.

According to another embodiment, the clip also includes at least one clip extension connected to a periphery wall of the clip housing at a first end of the clip extension and connected to a periphery wall of the hard tag housing at a second end of the clip extension.

According to one aspect of one embodiment, the second end of the clip extension includes a clip insert and the periphery wall of the hard tag housing includes a housing recess. The clip insert resides in the housing recess for the connection of the second end of the clip extension to the periphery wall of the hard tag housing.

According to another aspect of another embodiment, the second end of the clip extension includes a first portion of a hinge and the periphery wall of the hard tag housing includes a second portion of the hinge for the connection of the second end of the clip extension to the periphery wall of the hard tag housing.

According to another aspect, the clip also includes an additional clip extension located on an opposite side of the periphery wall of the hard tag housing from the clip extension connected by the hinge. The additional clip extension is connected to the periphery wall of the clip housing at a first end of the additional clip extension and connected to a periphery wall of the hard tag housing at a second end of the additional clip extension. The additional clip extension includes a clip insert and the periphery wall of the hard tag housing includes a housing recess. The clip insert of the additional clip extension resides in the housing recess for connection of the second end of the additional clip extension to the periphery wall of the hard tag housing.

According to another embodiment, the clip housing includes a lower housing plate and an upper housing plate. The upper housing plate is connected to the lower housing plate by a seam around a periphery wall of the clip housing. The information element is located underneath the upper housing plate and above the lower housing plate and surrounded by the seam about the edges of the information element.

According to another embodiment, the information element is surrounded at the edges by a periphery wall of the clip housing. The periphery wall includes a bent ridge extending from the top of the periphery wall over a portion of the information element to secure the information element about the clip housing.

Embodiments of this disclosure are directed to a method for supplementing a security hard tag. The method includes providing a clip. The method also includes providing indicia about a clip housing of the clip. The method also includes attaching the clip housing to a hard tag housing of the security hard tag.

According to one embodiment, the method also includes positioning the indicia on the surface of the clip housing.

According to another embodiment, the method also includes displaying the indicia on an information element.

According to one aspect of one embodiment, the indicia displayed on the information element is in the form of an advertisement, a price, a bar code, a promotional, a logo, an image, or a product description.

According to one embodiment, the method also includes connecting a second end of the clip extension to a periphery wall of the hard tag housing. A first end of the clip extension is in connection with a periphery wall of the clip housing.

According to one aspect of one embodiment, the method also includes inserting a clip insert into a housing recess located about the periphery wall of the hard tag housing for connection of the second end of the clip extension to the periphery wall of the hard tag housing. The clip insert is located on the second end of the clip extension.

According to another aspect of another embodiment, the method also includes connecting the second end of the clip extension to the periphery wall of the hard tag housing with a hinge. The method also includes positioning the information element about the clip housing. Positioning the information element about the clip housing includes swinging the clip housing away from the hard tag housing with the hinge. Positioning the information element also includes placing the information element on a surface of the hard tag housing. Positioning the information element also includes swinging the clip towards and onto the hard tag housing with the hinge to secure the information element between the surface of the hard tag housing and the clip housing.

According to another embodiment, the method also includes connecting an upper housing plate to a lower housing plate at a seam around a periphery wall of the clip housing to form the clip housing. The method also includes placing the information element underneath the upper housing plate and above the lower housing plate. The information element is surrounded by the seam about the edges of the information element.

According to another embodiment, the method also includes securing the information element about the clip housing by a bent ridge extending over a portion of the information element. The bent ridge extends from the top of a periphery wall of the clip housing. The periphery wall of the clip housing surrounds the edges of the information element.

Additional features and advantages of this disclosure will be made apparent from the following detailed description of illustrative embodiments that proceeds with reference to the accompanying drawings.

BRIEF DESCRIPTION OF THE DRAWINGS

The foregoing and other aspects of this disclosure are best understood from the following detailed description when read in connection with the accompanying drawings. For the purpose of illustrating this disclosure, there is shown in the drawings embodiments that are presently preferred, it being understood, however, that this disclosure is not limited to the specific instrumentalities disclosed. Included in the drawings are the following Figures.

DETAILED DESCRIPTION OF ILLUSTRATIVE EMBODIMENTS

This document describes an advertisement clip, also referred to as 'clip', and method for attaching the advertisement clip to a security hard tag, also referred to as 'hard tag'. The clip is configured to attach to the security hard tag. The clip may include indicia located about a housing of the clip. In this disclosure, and in reference to the visible indicial location about the clip housing, 'about' may be defined as: located on some surface of the clip housing, such as the exterior surface of the housing; in proximity to the housing, such as underneath or on top of the housing as located on an information element; or within the clip housing, such as between two plates of the housing. 'Indicia' may be defined as an indication, message, sign, instruction, or something to be made known. The indicia may be visible and used for promotion, pricing, merchandise information, and/or customer specific branding. The indicia may be intended for presentation to the customer, retailer, and/or manufacturer.

The advertisement clip may not be restricted to only providing "advertisement" information or may not be used for advertising. For example, indicia on or within the advertisement clip may be intended to be read by, for example, a barcode scanner, such that the indicia is a barcode. The indicia may directly be applied, as in printed or etched for example, onto a portion of the advertisement clip, including the surface of the advertisement clip. In alternative, the advertisement clip may contain or hold an information element, on or in which the indicia may be located. The advertisement clip is configured to attach about the hard tag and may be used whether the hard tag is or is not attached to merchandise. The advertisement clip may be used to present indicia whether or not the security hard tag is active (i.e. containing a working security element inside).

Figure 1:
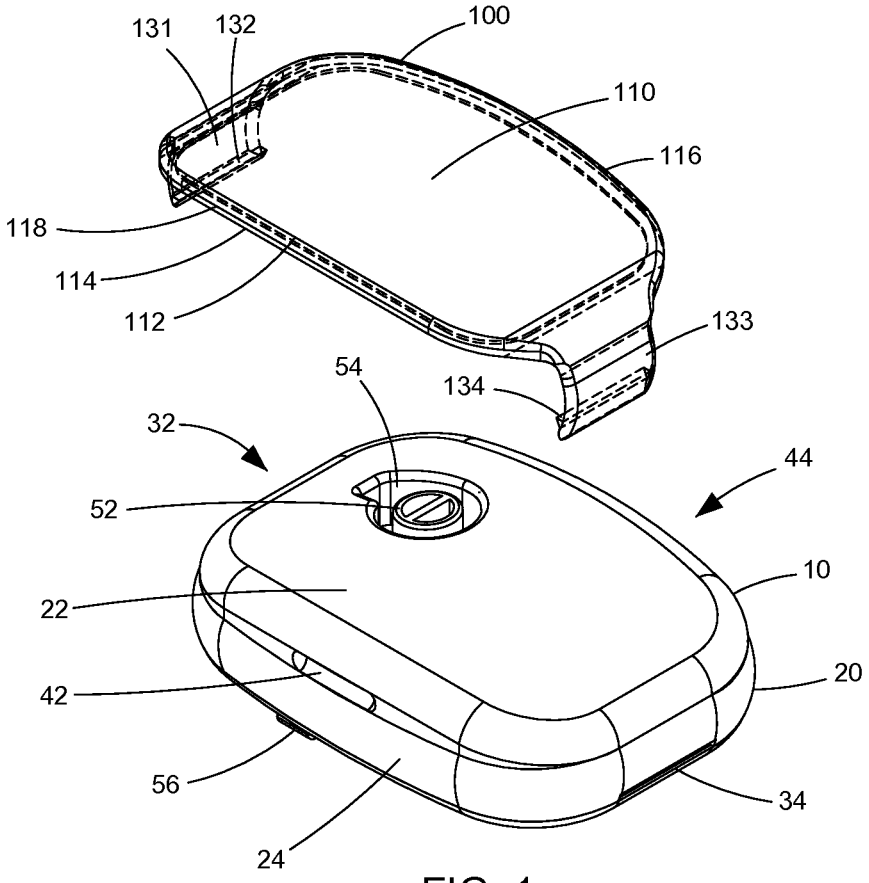
FIG. 1 illustrates a perspective view of advertisement clip separate from security hard tag according to one embodiment.

FIG. 1 illustrates a perspective view of advertisement clip 100 separate from security hard tag 10. The security hard tag 10, in FIG. 1, may enclose one or more various types of security elements within the hard tag housing 20. The security hard tag 10 shown in FIG. 1 may contain either an acousto-magnetic element (AM), a radio frequency element (RF), or an electro-magnetic element (EM). In alternative, the security hard tag 10 shown in FIG. 1 may contain a radio frequency identification (RFID) element within the housing. In alternative, the security hard tag 10 shown in FIG. 1 may contain a benefit denial device, such as an ink releasing element. In the preferred embodiment, shown in FIG. 1, the security hard tag 10 includes a RF element (not shown), comprising a LC circuit which includes inductor coil and capacitor components (not shown). The RF element in the security hard tag 10 is an inductor/capacitor (LC) circuit that may alarm at a detector as the detector sweeps for the resonant frequency of the tag. The resonance peak of the LC circuit may be anywhere between 1.75 MHz to 9.5 MHz, wherein 8.2 MHz is the more popular frequency in the industry.

Figure 3:
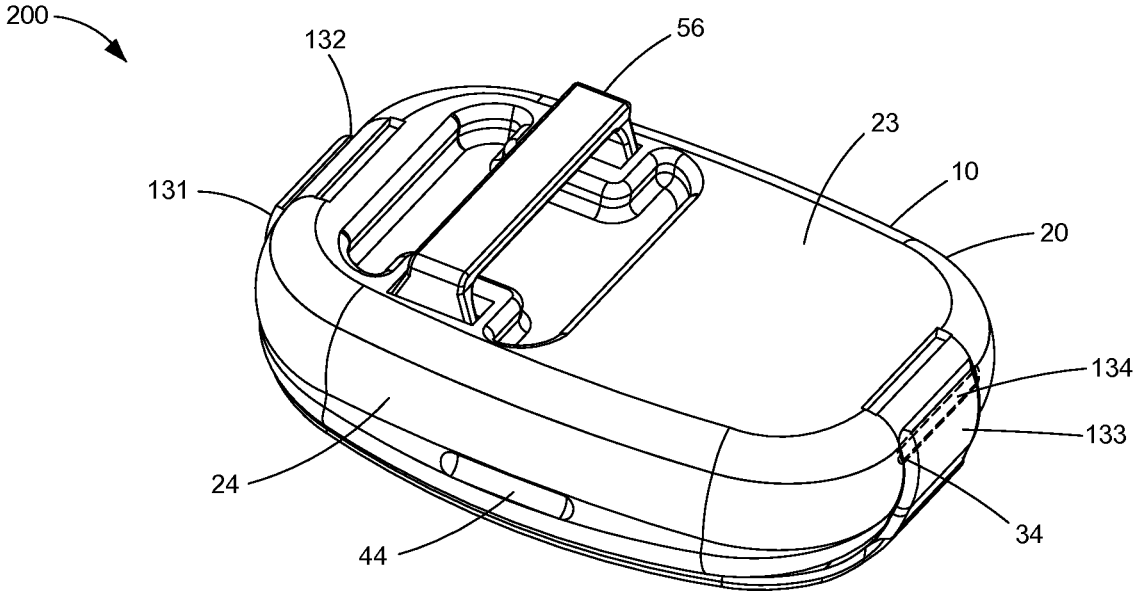
FIG. 3 illustrates a perspective view of the bottom side of the advertisement clip hard tag of FIG. 2.

As shown in FIG. 1, security hard tag 10 includes a hard tag housing 20 that forms the outer shell of the security hard tag 10, enclosing the security element and at least some portion of a locking element within. As shown in FIG. 1, the hard tag housing 20 is formed by a hard tag top-side housing piece 22 and a bottom-side housing piece 23 (see FIG. 3). The hard tag top-side housing piece 22 and bottom-side housing piece 23 (see FIG. 3) connect about the housing periphery wall 24, running around the sides of the security hard tag 10.

As shown in FIG. 1, the hard tag top-side housing piece 22 is generally flat, except for where the central post 52 extends through the opening 54, located on the surface of the hard tag top-side housing piece 22. A detacher (not shown) may be inserted into the opening 54, over the central post 52, and then rotated so as to release the attachment clip 56 (see FIG. 3) and therefore the security hard tag 10 from an article of merchandise, where the article of merchandise is locked between the advertisement clip 56 and the bottom-side housing piece 23 before the attachment clip 56 is released. The central post 52, opening 54, attachment clip 56, and detacher, all of which form locking elements of the security hard tag 10 for attaching and detaching to an article of merchandise, are further shown and described in U.S. Pat. No. 8,344,891, which is hereby incorporated by reference and which is assigned to Checkpoint Systems. The surface of hard tag bottom-side housing piece 23 may not be as flat as the top-side housing piece 22, due to the existence of an attachment clip 56 and connections of the attachment clip 56 about the bottom-side housing piece 23. In other embodiments, the hard tag top-side housing piece 22 may be more flat than, or not as flat as, that shown in FIG. 1. In other embodiments, the hard tag bottom-side piece 23 may be more flat than in the preferred embodiment shown.

In other embodiments, the security hard tag 10 may feature other types of locking mechanisms including similar or different locking elements. As an example, a spring-loaded, ball/clutch locking device, which is known in the industry, may serve as alternative to the locking mechanism described in U.S. Pat. No. 8,344,891. The spring-loaded, ball/clutch locking mechanism may include a spring, compressing chamber, and balls, of which a pin of a locking pin may be applied into the security hard tag 10, as for example through the hard tag bottom-side housing piece 23, such that a garment may be enclosed between the locking pin head and security hard tag 10 against the hard tag bottom-side housing piece side 23, where a pin cavity for accepting the pin may reside.

In the preferred embodiment, advertisement clip 100, as shown in FIG. 1, includes an advertisement housing 110, a first length edge clip extension 131, and second length edge clip extension 133. The first length edge clip extension 131 and second length edge clip extension 133 each extend down from and transverse to the advertisement housing 110 from opposite sides of the advertisement housing 110. In the preferred embodiment, the length edge clip extensions 131, 133 extend nearly perpendicular to the advertisement housing 110. In other embodiments, the length edge clip extensions may form any angle with the advertisement housing 110. In this embodiment, the clip extensions 131 and 133 are symmetrically located across from one another as connected to the advertisement housing periphery wall 116. The advertisement housing periphery wall 116 surrounds the external edge of the advertisement housing 110. The first length edge clip extension 131 and second length edge clip extension 133 are shown equal is size and shape. In other embodiments, the clip extensions 131, 133 may not be equal in size or shape.

In the preferred embodiment, the advertisement housing 110 is formed by an upper advertisement housing plate 112 and lower advertisement housing plate 114, which are equal in size and shape and connect to each other along the advertisement housing periphery wall 116 at the advertisement housing connection seam 118. With the upper advertisement housing plate 112 connected to the lower advertisement housing plate 114 at the advertisement housing connection seam 118, a thin cavity is formed between the two plates 112, 114 across the area of plates 112 and 114, confined between the advertisement housing periphery wall 116 as inside the advertisement housing 110. The upper advertisement housing plate 112 may be disconnected and reconnected to the lower advertisement housing plate 114 at the advertisement housing connection seam 118. Either plate 112, 114 may contain a male extension and the other a female container at the seam 118 so that the two plates 112, 114 properly mate at the seam 118 to maintain connection of the plates 112, 114. Pulling apart the two plates 112, 114 with sufficient force about the seam 118 may separate the two plates 112, 114 and pushing the two plates 112, 114 with sufficient force may connect the two plates 112, 114 at the seam 118. For example, fingers of a retail employee or the flat head of a screwdriver may be used to disconnect the upper advertisement housing plate 112 from the lower advertisement housing plate 114. In the preferred embodiment, at least the upper advertisement housing plate 112 of the two plates 112, 114 is transparent. As shown in FIG. 1, both the upper advertisement housing plate 112 and bottom advertisement housing plate 114 are transparent.

The thin cavity formed between the two plates 112, 114 when the plates 112, 114 are connected may provide space for an information element 150 (see FIG. 6) to be inserted and positioned within. In the preferred embodiment, the information element 150 would be visible as located under the transparent upper advertisement housing plate 112. The information element 150 may be located under the upper advertisement housing plate 112 and above the bottom advertisement housing plate 114. In this location, the information element 150 may be surrounded by the seam 118 about the edges of the information element 150.

The information element 150 may be constructed of material thin enough to reside in the advertisement housing 110. The material may include paper, thin cardboard, plastic, etc. The material may include two pieces such that indicia on a third piece of material is secured between the two pieces, such as for example in a pocket between two pieces of paper adhered to one another about the edges. The indicia may be printed or etched onto the material. Indicia may include an advertisement, any other promotional material (e.g. the word 'SALE'), pricing, a barcode, a logo, product description for which the security hard tag 10 is attached, descriptions of other products, etc., or any combination of the above. The indicia may also be an image. The image may be picture(s), design(s), or other art to in-part diminish the visual hindrance of the security hard tag 10. The image may include colors, for example, that coordinate with the color on the product. The image may be of the product itself, or a picture of the product in use. The image may be a painting or a photograph. Alternatively, the information element 150 may be colored for identification purposes. For example, the information element 150 may be of one solid color so that a retailer may categorize the product based on the color of the information element 150 shown in the advertisement housing 110. For example, socks by one clothing manufacturer may be color coded with different color(s) on the information element 150 than socks by another clothing manufacturer. A color-coded information element may be used to identify location of where the merchandise should be located in the store. It may also be used to identify where the product may be found or where the product should be located in the backroom of a store. The color could designate a particular zone of the store, such as for example near the register, in a particular aisle, or in a display window. In other embodiments, the advertisement clip 100 itself may be a certain color or include a particular pattern or image, as the visible indicia, on the surface of the advertisement clip housing 110.

As shown in FIG. 1, the first length edge clip extension 131 includes a first length edge clip insert 132, extending transverse to the first length edge clip extension 131 and facing inwards towards the second length edge clip insert 134 positioned on the second length edge chip extension 133, such that the edge clip extensions 131 and 133 are symmetrically aligned on opposing sides of the advertisement clip 100. The clip insets 132, 134 are located closer to one end of the length edge clip extensions 131, 133 than to the other end of the length edge clip extensions 131, 133 in connection with the advertisement housing 110. In other embodiments, only one length edge clip insert may exist for one or more length edge clip extensions. In other embodiments, only one length edge clip extension and one length edge clip insert may exist. In other embodiments a length edge clip extension may include one or more length edge clip inserts located on the length edge clip extension.

Figure 2:
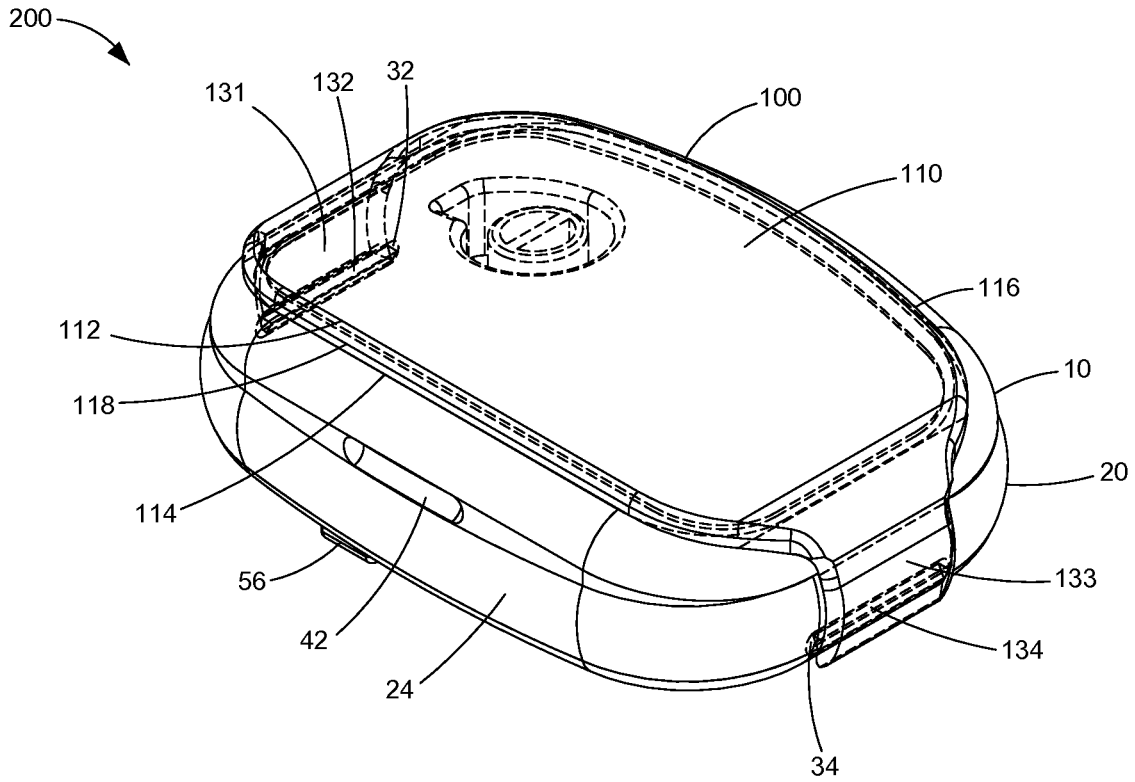
FIG. 2 illustrates a perspective view of advertisement clip of FIG. 1 in connection with the security hard tag forming the advertisement clip hard tag according to one embodiment.

FIG. 2 illustrates a perspective view of advertisement clip 100 of FIG. 1 in connection with security hard tag 10 forming the advertisement clip hard tag 200. As shown in FIG. 2, the advertisement clip 100 is attached over the hard tag top-side housing piece 22 (see FIG. 1) of security hard tag 10. The advertisement clip 100 may be connected to the security hard tag 10 by pushing the advertisement housing 110 of the advertisement clip 100 down and onto the surface of hard tag top-side housing piece 22. First length edge clip extension 131 and second length clip extension 133 extend in a direction away from each other, as each extension 131, 133 slides over opposite sides of the housing periphery wall 24 from each other. The extensions 131, 133 continue to slide down the housing periphery wall 24 as force is applied down onto the top-side surface of the advertisement housing 110 above hard tag top-side housing piece 22, until advertisement clip 100 attaches to security hard tag 10.

The advertisement clip 100 attaches onto security hard tag 10 when second length edge clip insert 134 enters second lower length edge housing recess 34 and first length edge clip insert 132 enters first lower length edge housing recess 32. Second lower length edge housing recess 34 is located on a side of hard tag housing 20 along the housing periphery wall 24. First lower length edge housing recess 32 is located on the opposite side of the hard tag housing 20, along the housing periphery wall 24, from the second lower length edge housing recess 34. When the advertisement clip 100 is locked onto and in attachment with the security hard tag 10, the advertisement clip hard tag 200 is formed. In some embodiments, for an advertisement clip 100 having only two length edge clip extensions, such as length edge clip extensions 131 and 133, the security hard tag may or may not include upper width edge housing recesses 42, 44. In some embodiments, for an advertisement clip 100 having only two width edge clip extensions, such as width edge clip extensions 141 and 143, the security hard tag may or may not include lower length edge housing recesses 32, 34.

To unlock the advertisement clip 100 from the security hard tag 20, the first length edge clip extension 131 and second length edge clip extension 133 may be pulled away in direction from the hard tag housing 20 so that the first length edge clip insert 132 exits the first lower length edge housing recess 32 and the second length edge clip insert 134 exits the second lower length edge housing recess 34.

The advertisement clip 100 may be removed from the security hard tag 10 by a retailer or manufacturer to modify or change the information element 150 located in or on the advertisement housing 110. For example, the advertisement clip 100 may be removed and the advertisement housing 110 opened so that information element 150, that may include for example a displayed price, may be removed and replaced by another information element 150 including for example an updated price. In another example, a barcode located on an information element 150 on or in the advertisement housing 110, may be replaced with another information element 150 having another barcode, when for example the advertisement clip hard tag 200 is removed from merchandise bought at the register and then applied on other merchandise, which may or may not be a different product than the item of which the advertisement clip hard tag 200 was originally attached to. If the advertisement clip 100 is removed or broken by a potential thief, the modification and/or destruction on the advertisement clip 100 may not alter or disrupt the workings of the security hard tag 10, including the security element within.

In another embodiment, advertisement clip 100 may include only one advertisement housing plate as opposed to two, such as upper advertisement housing plate 112 and lower advertisement housing plate 114. In one embodiment, the one advertisement housing plate covers the information element 150 inserted below the surface of the one advertisement housing plate and over top of the surface of the hard tag top-side housing piece 22. In some embodiments, the information element 150 may be placed above the surface of the hard tag top-side housing piece 22 before the advertisement clip 100 is attached to the security hard tag 10. In other embodiments, the information element 150 may be adhered to the top-side housing piece 22 or to the bottom-side surface of the advertisement housing plate before the advertisement clip 100 is attached to the security hard tag 10.

Figure 4:
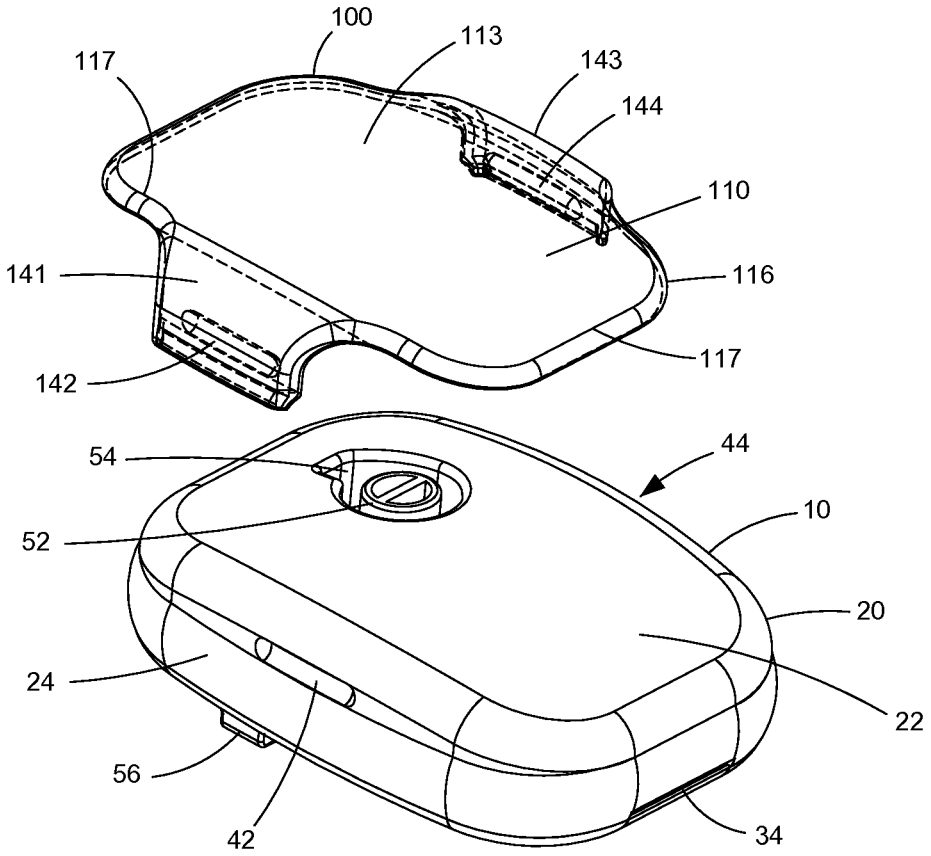
FIG. 4 illustrates a perspective view of advertisement clip separate from security hard tag, with advertisement clip extensions located on different sides of the advertisement clip than shown in FIG. 1, according to another embodiment.
Figure 5:
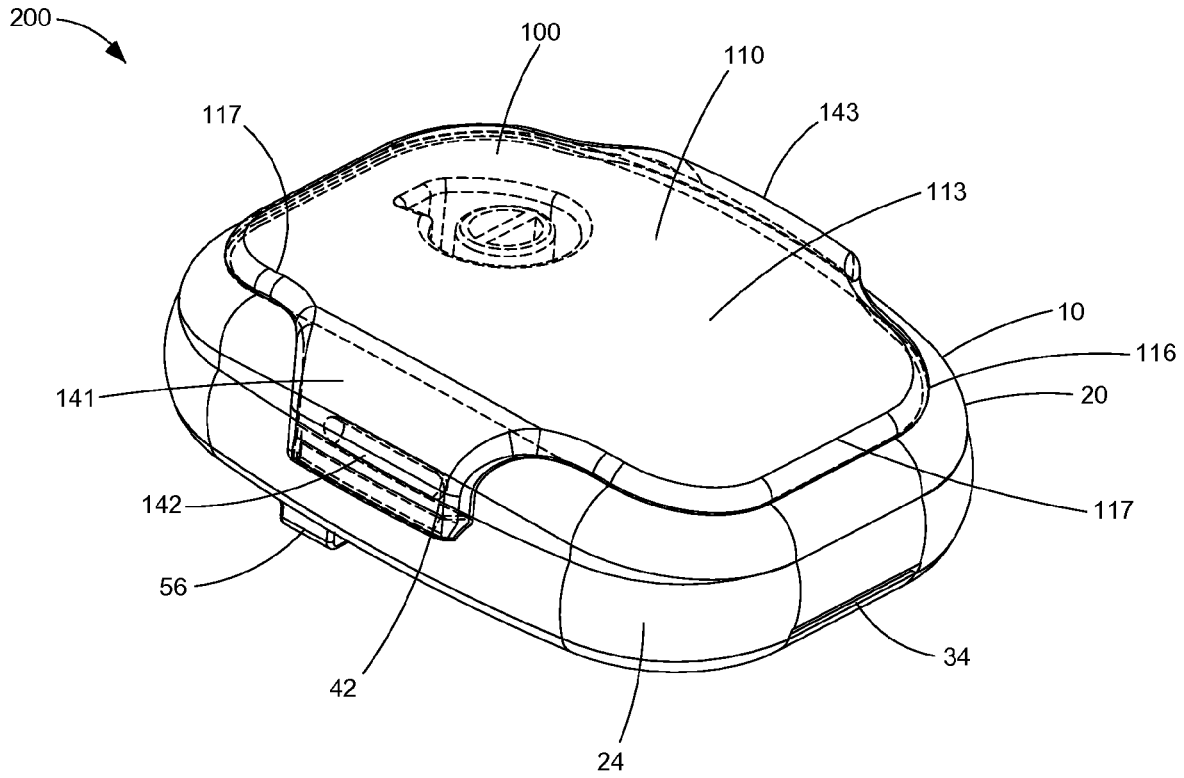
FIG. 5 illustrates a perspective view of advertisement clip of FIG. 4 in connection with the security hard tag forming the advertisement clip hard tag according to one embodiment.
Figure 6:
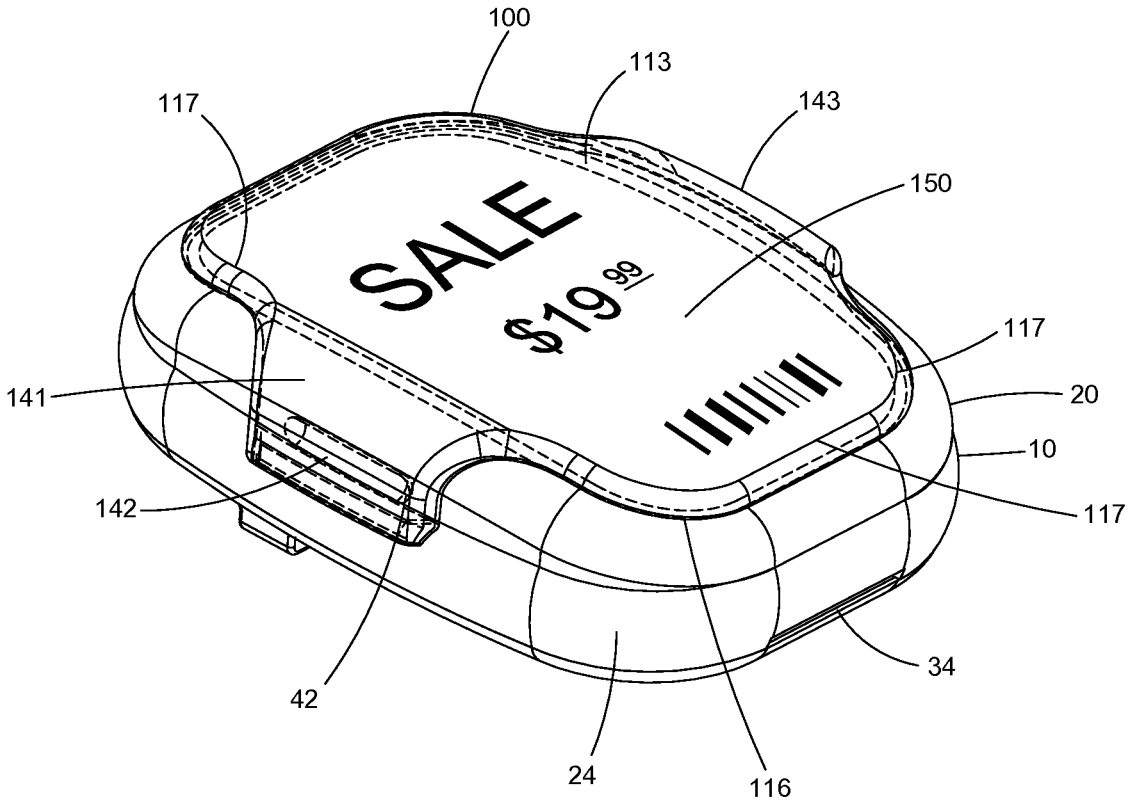
FIG. 6 illustrates a perspective view of the advertisement clip hard tag of FIG. 5 with an information element shown on the advertisement housing according to one embodiment.

In another embodiment, the information element 150 may be placed on the top side of a single advertisement housing plate (see FIG. 6 as example). In this embodiment, the advertisement housing periphery wall 116 may extend above and transverse to the surface of the single advertisement housing plate and include a bent upper ridge 117 extending slightly over the surface of the single advertisement housing plate, as shown in FIGS. 4 through 6 and thus over a portion of the information element 110 when located over the surface of the single advertisement housing plate 113. In this embodiment, the information element 150, may remain secured to the top side surface of the single advertisement housing plate 113 solely by the bent upper ridge 117 of the extended housing periphery wall 116 over the single advertisement housing plate 113 or in combination with adhesive applied to the information element 150 to attach to the single advertisement housing plate 113. In other embodiments, no housing plate may exist in the advertisement clip 100 and instead only a periphery wall 116 and any edge clip extensions in connection with the periphery wall 116 may exist to form the advertisement housing 110. In these embodiments, a bent upper ridge 117 on the periphery wall 116 would secure the information element 150 located on the surface of the top-side housing piece 22.

In other embodiments, whether the advertisement housing 110 includes one or multiple advertisement housing plates, the advertisement housing 110 may not be transparent. For a housing that may not be transparent, indicia may be printed directly onto the outside surface of the advertisement clip 100 as visible to a potential customer or to the retailer. For example, a barcode may be etched or printed onto the surface of the advertisement housing 110 for exposure to be read by a barcode scanner. In other embodiments, the indicia may be located in or on the non-transparent housing, on the under side of the advertisement housing plate, being the side facing the hard tag top-side housing piece 22 when the advertisement clip 100 is attached to the security hard tag 10 to form the advertisement clip hard tag 200. In this embodiment, the indicia may be printed or etched directly onto this under-side surface of the advertisement housing plate or on an information element 150 that may be attached, by for example with adhesive, to this under-side surface of the housing plate. Or the information element 150 may simply be located over the hard tag top-side housing piece 22 and under the non-transparent advertisement housing 110. This information may be placed in these positions intentionally from out of view of the customer. The information may include content for benefit of the manufacturer or retailer. In other embodiments, when the advertisement housing 100 includes more than one advertisement housing plate, such as an upper advertisement housing plate 112 and lower advertisement housing plate 114, information element 150 may be placed in the advertisement housing 110, but concealed from customer view when the housing is non-transparent. Again, the information element 150, in this example, may include indicia solely for the benefit of the manufacturer or retailer.

In other embodiments, more than two advertisement housing plates may be used, such that, for example, additional information elements 150 may be located in or on the same advertisement clip hard tag 200 with at least one housing plate located between each information element 150. In this embodiment, for example, an information element 150 at the top, further from the hard tag top-side housing piece 22 than another information element 150 may be used for advertisement, and the other information element located below and closer to the hard tag top-side housing piece 22 may be concealed with indicia intended for the manufacturer or retailer.

In other embodiments, the information element 150 in the preferred or alternative embodiments, may be attached, as for example adhered, to the bottom-side or top-side surface of the housing plate prior to attaching the advertisement clip 100 to the security hard tag 10.

In some embodiments, the information element 150 may be an RFID inlay that provides the retailer with, for example, indicia pertaining to location of the tag, and/or other indicia related to inventory or sale that can be read by a RFID reader when transmitted from the RFID inlay.

In other embodiments, more than one advertisement clip 100 may be attached to the security hard tag 10. For example, a second advertisement clip 100 may be attached to the hard tag bottom-side housing piece 23 (see FIG. 3) on the opposite side of the security hard tag 100 from an advertisement clip 100 attached to the hard tag top-side housing piece 22, as shown in FIG. 2. In other embodiments, one advertisement clip may stack over another advertisement clip 100, attached to the security hard tag 10. For example, an advertisement clip 100 attached directly to the security hard tag 10 may enclose an information element 150 having a barcode. An advertisement clip 100 stacked and attached onto and above the advertisement clip 100 attached directly to the security hard tag 10, may enclose an information element 150 showing, for example, a price. The customer can see the price from the top advertisement clip 100, but may not be able to view the barcode in the advertisement clip 100 located between the security hard tag 10 and the advertisement clip above having the information element 150 with price. At purchase, the retailer may remove the top advertisement clip, and then scan the barcode on the bottom advertisement clip before removing the advertisement clip hard tag 200 from the merchandise. In other embodiments, with either stacked advertisement clips 100 or stacked housing plates, one on top of another, the bottom housing plate or clip closest to the security hard tag 10 may be slightly larger than the housing plate or clip located above it. In this embodiment, for example, the information element in the bottom housing plate or clip may be larger than the information element located in the housing plate or clip above. Thus a portion of the bottom information element may be exposed or visible, such that for example, a bar code or price on the bottom information element can be seen without having to remove the top information element, which may include for example an advertisement image. In other embodiments, the housing plates or clips stacked above or below other housing plates or clips may be of similar or different sizes and/or shapes. For the stacked advertisement clips, the bottom advertisement clips may include a recess located on the external side of the edge clip extension(s) and opposite the side where the clip insert is located, such that the advertisement clip stacked directly above another may attach into the recess of the bottom advertisement clip with the clip insert located on the internal side of its own edge clip extension(s).

In other embodiments, advertisement clip 100 may include one or more length edge clip extensions. In one embodiment, if the advertisement clip 100 includes only one length edge clip extension, as for example such as only the second length edge clip extension 133, then at least a portion of the second length edge clip extension 133 may be flexible, made from flexible material (i.e. soft plastic, rubber, etc.). Thus, when the second length edge clip insert 134 is inserted in second lower length edge housing recess 34, the advertisement housing 110 may be lifted away or closed down onto the hard tag top-side housing piece 22 with the bending of the flexible second length edge clip extension 133.

In other embodiments, the advertisement clip 100 may comprise four length edge clip extensions, each including length edge clip inserts, and all symmetrically aligned from one another in connection with the four sides of the advertisement housing periphery wall 116. In other embodiments, the length edge clip extensions may not be symmetrically located about the advertisement perimeter wall 116 from one another.

FIG. 4 illustrates a perspective view of advertisement clip 100 separate from security hard tag 10, with advertisement clip extensions located on different sides of the advertisement clip 100 than in FIG. 1. In this alternative embodiment, first width edge clip extension 141 is located on the longer length edge of the rectangular shaped advertisement housing periphery wall 116 than the shorter width edge of advertisement housing periphery wall 116 where first and second length edge clip extensions 131, 133 are located (see FIG. 1). Second width edge clip extension 143 is located on the opposite side of the advertisement clip 100 from first width edge clip extension 141. Advisement clip 100 is attached as described in reference to FIG. 1 and FIG. 2, except that first width edge clip insert 142, located on first width edge clip extension 141, fits into first upper width edge housing recess 42 and second width edge clip insert 144, located on second width edge clip extension 143, fits into second upper width edge housing recess 44. In this embodiment, advertisement housing 110 is a single advertisement housing plate 113. In this embodiment, the advertisement housing periphery wall 116 extends above and transverse to the surface of the single advertisement housing plate 113 and includes a bent upper ridge 117 extending slightly over the surface of the single advertisement housing plate 113. In this embodiment, the information element 150 may remain secured to the top side surface of the single advertisement housing plate 113 by the bent upper ridge 117 of the extended housing periphery wall 116 over the single advertisement housing plate 113.

FIG. 5 illustrates a perspective view of advertisement clip 100 of FIG. 4 in connection with security hard tag 10 forming the advertisement clip hard tag 200. The advertisement clip 100 is locked about security hard tag 10 to form advertisement clip hard tag 200 when first width edge clip insert 142 fits into first upper width edge housing recess 42 and second width edge clip insert 144 fits into second upper width edge housing recess 44.

FIG. 6 illustrates a perspective view of the advertisement clip hard tag of FIG. 5 with an information element 150 shown on the advertisement housing and secured by the bent upper ridge 117. Shown on the surface of the information element 150 are several visible indicia including a barcode, a price, and the word 'SALE'.

Figure 7:
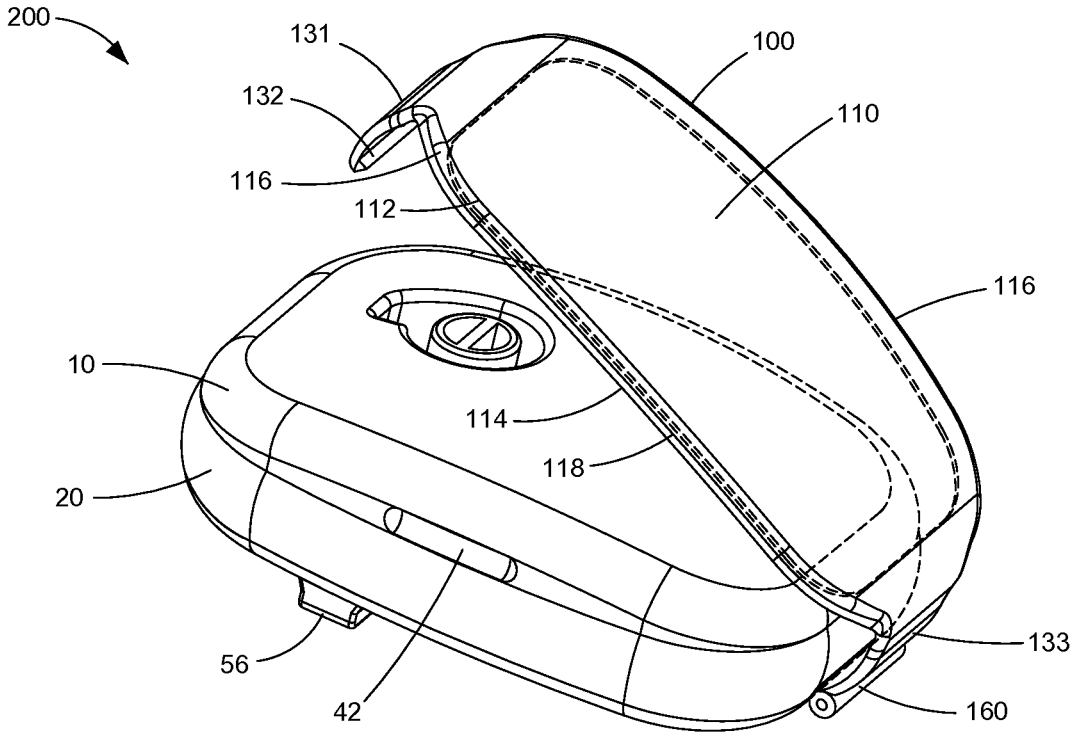
FIG. 7 illustrates a perspective view of an advertisement clip in connection with the security hard tag by a hinge according to one embodiment.

In other embodiments, the advertisement clip 100 may not entirely be removed from the security hard tag 10. For example, the second length clip insert 34 connection at the second lower length edge housing recess 34 may be replaced by a hinge 160, such that the advertisement clip 100 may rotate or swing onto or off the top-side housing piece 22 of the security hard tag 10 by the hinge. FIG. 7 illustrates a perspective view of an advertisement clip 100 in connection with the security hard tag 10 by a hinge 160. In this embodiment, a portion of the hinge 160 connects about the hard tag housing 20, at for example where the second lower length edge housing recess 34 was located (see FIG. 1) and the other portion of the hinge 160 connects where the second length edge clip insert 134 is positioned on the second length edge extension 133 (see also FIG. 1). In this embodiment, the advertisement clip 100 may still be secured at the other end of the security hard tag 10 by the first length edge clip insert 132 connection with the first length edge housing recess 32. In some embodiments, the advertisement clip 100 may be swung away form the security hard tag 10 about the hinge 160 and then the information element 150 placed over the hard tag top-side housing piece 22. The advertisement clip 100 may then be swung down and over the information element 150 to secure the information element 150 onto the hard tag top-side housing piece 22. In other embodiments, the hinge 160 may be located anywhere about the security hard tag 10 or advertisement clip 100.

In other embodiments, the advertisement clip 100 may be removed and replaced with an advertisement clip already having the information element 150 enclosed, as opposed to changing out the information element 150 in the same advertisement clip 100. If the advertisement clip 100 cracks or breaks or the indicia on the information element 150 inside the clip housing 110 is not visible then the advertisement clip 100 may be replaced with a new or functioning advertisement clip 100. The capability to swap out one advertisement clip 100 for another provides a retailer or product manufacturer with choice and flexibility in what type of indicia, as for example applied to an information element 150, and when that indicia may be provided to the customer or provided internally or between the manufacturer and retailer.

In other embodiments, advertisement clip 100 may be larger or smaller in area than the hard tag top-side housing piece 22 or bottom-side housing piece 23. The advertisement clip 100 may be any shape including oval, circular, or square. The advertisement clip 100 may or may not match the shape of a particular surface of the security hard tag 10 of which the advertisement clip 100 is to attach over. In other embodiments, the advertisement clip 100 may have openings through the housing 110. For example, an opening may be located in the housing 110 so as to fit a detacher (not shown) through the housing 110 and into opening 54 and around central post 52, such that a retailer does not have to remove the advertisement clip 100 before applying the detacher to the security hard tag 10.

Although this disclosure has been described with reference to exemplary embodiments, it is not limited thereto. Those skilled in the art will appreciate that numerous changes and modifications may be made to the preferred embodiments and that such changes and modifications may be made without departing from the true spirit of this disclosure. It is therefore intended that the appended claims be construed to cover all such equivalent variations as fall within the true spirit and scope of this disclosure.

What is claimed is:

1. A system, comprising:

a security hard tag;

a clip;

a clip housing;

an information element about the clip housing, wherein indicia is located on or within the information element; and a clip extension connected to a periphery wall of the clip housing at a first end of the clip extension and connected to a periphery wall of the hard tag housing at a second end of the clip extension, wherein the second end of the clip extension comprises a first portion of a hinge and the periphery wall of the hard tag housing comprises a second portion of the hinge for the connection of the second end of the clip extension to the periphery wall of the hard tag housing, and wherein the clip housing is configured to attach to a hard tag housing of the security hard tag.

2. The clip of claim 1, wherein the indicia is located on the surface of the clip housing.

3. The clip of claim 1, wherein the indicia is displayed on the information element in at least one form of an advertisement, a price, a bar code, a promotional, a logo, an image, or a product description.

4. The clip of claim 1, wherein the information element is a RFID inlay.

5. The clip of claim 1, wherein the second end of the clip extension comprises a clip insert and the periphery wall of the hard tag housing comprises a housing recess, wherein the clip insert resides in the housing recess for the connection of the second end of the clip extension to the periphery wall of the hard tag housing.

6. The clip of claim 1, further comprising an additional clip extension located on an opposite side of the periphery wall of the hard tag housing from the clip extension connected by the hinge, wherein the additional clip extension is connected to the periphery wall of the clip housing at a first end of the additional clip extension and connected to a periphery wall of the hard tag housing at a second end of the additional clip extension, and wherein the additional clip extension comprises a clip insert and the periphery wall of the hard tag housing comprises a housing recess, wherein the clip insert of the additional clip extension resides in the housing recess for connection of the second end of the additional clip extension to the periphery wall of the hard tag housing.

7. The clip of claim 1, wherein the clip housing comprises:

a lower housing plate; and an upper housing plate, wherein the upper housing plate is connected to the lower housing plate by a seam around a periphery wall of the clip housing, and wherein the information element is located underneath the upper housing plate and above the lower housing plate and surrounded by the seam about the edges of the information element.

8. A method, comprising:

providing a security hard tag;

providing a clip;

providing a clip housing of the clip;

providing an information element;

displaying the indicia on the information element;

connecting a second end of a clip extension to a periphery wall of the hard tag housing, wherein a first end of the clip extension is in connection with a periphery wall of the clip housing;

connecting the second end of the clip extension to the periphery wall of the hard tag housing with a hinge;

positioning the information element about the clip housing, comprising:

swinging the clip housing away from the hard tag housing with the hinge;

placing the information element on a surface of the hard tag housing; and swinging the clip towards and onto the hard tag housing with the hinge to secure the information element between the surface of the hard tag housing and the clip housing; and attaching the clip housing to a hard tag housing of the security hard tag.

9. The method of claim 8 further comprising positioning the indicia on the surface of the clip housing.

10. The method of claim 8, wherein the indicia displayed on the information element is in the form of an advertisement, a price, a bar code, a promotional, a logo, an image, or a product description.

11. The method of claim 8, further comprising inserting a clip insert into a housing recess located about the periphery wall of the hard tag housing for connection of the second end of the clip extension to the periphery wall of the hard tag housing, wherein the clip insert is located on the second end of the clip extension.

12. The method of claim 8, further comprising:

connecting an upper housing plate to a lower housing plate at a seam around a periphery wall of the clip housing to form the clip housing; and placing the information element underneath the upper housing plate and above the lower housing plate, wherein the information element is surrounded by the seam about the edges of the information element.

13. A method, comprising:

providing a security hard tag;

providing a clip;

providing an information element;

providing indicia about a clip housing of the clip, wherein the indicia is displayed on the information element;

securing the information element about the clip housing by a bent ridge extending over a portion of the information element, wherein the bent ridge extends from the top of a periphery wall of the clip housing, and wherein the periphery wall of the clip housing surrounds the edges of the information element; and attaching the clip housing to a hard tag housing of the security hard tag.

14. The method of claim 13, wherein the indicia is displayed on the information element in at least one form of an advertisement, a price, a bar code, a promotional, a logo, an image, or a product description.

15. The method of claim 13, wherein the information element is a RFID inlay.

16. The method of claim 13, further comprising inserting a clip insert into a housing recess located about the periphery wall of the hard tag housing for connection of the second end of the clip extension to the periphery wall of the hard tag housing, wherein the clip insert is located on the second end of the clip extension.

* * * * *